US006471507B1

(12) United States Patent
Hall

(10) Patent No.: US 6,471,507 B1
(45) Date of Patent: Oct. 29, 2002

(54) WSL GAS IGNITER

(75) Inventor: David Eugene Hall, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/431,621

(22) Filed: Nov. 2, 1999

(51) Int. Cl.[7] ..... F23D 14/22
(52) U.S. Cl. ..... 431/72; 431/344; 374/8
(58) Field of Search ..... 431/1, 91, 158, 431/254, 344, 62, 72, 73; 60/39.826, 39.76; 374/8

(56) References Cited

U.S. PATENT DOCUMENTS 2,154,041 A * 4/1939 Gille ..... 431/73
2,417,835 A * 3/1947 Moore ..... 431/158
3,662,185 A * 5/1972 Sapir ..... 431/66
4,721,458 A * 1/1988 Conrad ..... 431/1
5,800,153 A * 9/1998 DeRoche ..... 431/1

* cited by examiner

*Primary Examiner*—Sara Clarke
(74) *Attorney, Agent, or Firm*—David Kalmbaugh

(57) ABSTRACT

The WSL Gas Igniter is, in essence, a small, reuasable gas bomb intended to be used in the testing of fire suppression systems. The device has two main parts. The main parts are the control box and the igniter head. The control box controls all aspects of operation. It controls the flow of all gases, as well as, the electrically powered ignition system. The igniter head contains an accumulation/combustion chamber in which a combustible mixture of gases is introduced. Also, the combustion chamber contains a small spark generating means. A control signal initiates a spark system and the flow of gases into the combustion chamber simultaneously. At the desired moment of ignition, the control signal is removed, which ceases the gas flow and ignites the combustible mixture of gases in the combustion chamber. The explosion produced by the invention is intended to ignite a test subject for the purpose of testing fire suppression capability.

17 Claims, 3 Drawing Sheets

WSL GAS IGNITER

The invention described herein may be manufactured and used by or for the government of the United States of America for governmental purposes without the payment of any royalties thereon or therefor.

MICROFICHE APPENDIX

Not Applicable.

BACKGROUND OF THE INVENTION

1. Field of the Invention

The Weapons Survivability Laboratory (WSL) at China Lake, Calif., routinely participates in the testing and evaluation of onboard aircraft firefighting systems. Obviously, in order to test fire suppression abilities, a fire must be created. As a result, an ignition system is required. However, given the unique needs and short program life of the typical project at WSL, the ignition system would ideally possess various attributes. The invention is more closely associated with igniters typically found in outdoor gas grills and stove burners than other typically used igniters at the WSL.

2. Prior Art

Pyrotechnic Igniters (Squibs)

Squibs are basically nothing more than a small wire coated with a highly flammable substance. In operation, an electrical current is passed through the wire. The wire heats up to the spontaneous combustion temperature associated with the flammable substance. The combustion of the flammable substance then ignites the test item.

For the purpose of most fire suppressant testing, squibs are almost ideal. However, they are not reusable. A test may require a fire ignition point deep within a aircraft or other test object. Thus, the usage of squibs can cause the cost of a test series to increase, because of the time and man hours required to disassemble the test object to the extent that a new squib may be installed.

Elecric Arc (Plasma) Igniters

In an electric arc igniter, a charge is accumulated in a bank of capacitors until said charge reaches some predetermined level. At this point, the charge is dissipated between two electrodes. The air between the electrodes becomes superheated and as a result, the test object is ignited.

Due their ease of use, availibilty and minimal safety considerations, electric arc igniters have been a very popular choice. However, electric arc igniters do possess several drawbacks. The energy delivered is marginal at best, 16–18 joules. They have a fairly high cost per unit, between $3,000.00 and $12,000.00. Due to the large electrical currents involved, they often interfere with test instrumentation. Finally, due to many variables involved, such as fluctuation of power supply and ambient temperature, the precise moment at which the capaciters discharge is largely unpredictable.

Hyperbolic Chemicals

Hypergolic chemicals are chemicals that spontaneously combust upon contact with each other. Within the context of high energy igniters, the most common example would be silene gas. Silene gas spontaneously ignites upon contact with air or oxygen.

When using hypergolic chemicals, safety is the greatest concern. Without exception, the chemicals involved with such systems are hazardous materials and as a result, they require special precautions. Not only are hypergolic chemicals extremely hazardous, they are also corrosive.

The most pertinent prior art is associated with gas igniter systems used in outdoor grills and stove burners. Also, elements of an automobile ignition system are used in the electrical system employed by the invention. However, the particular objects of the invention, the corresponding uses, and overall design of the invention lead to a creation that is novel with respect to that prior art.

SUMMARY AND OBJECTS OF THE INVENTION

The WSL Gas Igniter is, in essence, a small, reuasable oxygen/combustible gas bomb. The device has two main parts. The main parts are the control box and the igniter head.

The control box controls all aspects of operation. It controls the flow of all gases, as well as, the electrically powered ignition system. The igniter head contains an accumulation/combustion chamber in which a combustible mixture of gases is introduced. Also, the combustion chamber contains a small electrical igniter which may be a spark plug. As a result of the reaction produced by the invention, it can not maintain a flame for more than a few milliseconds. In other words, the result is an explosion rather than a sustained flame. In the preferred embodiment of the invention, the gases utilized are oxygen and acetylene. However, any combustible gas with a low molecular weight may be used, in place of acetylene, such as hydrogen.

The invention uses oxygen, rather than air, because the integrity of a test area must be maintained. Any contamination of the test area can affect the results of the test. The explosion created by the invention is isolated from the outside environment, so that, the data collected is reliable. Creating an environment free from outside influences, such as air, enables the data to accurately reflect the fire suppression capability of a particular area of a test article.

A method of testing fire suppression capability is disclosed herein. The first step is placing a gas igniter, as described herein, in a desired position within a test article. The second step is initiating a control signal that simultaneously energizes a spark system and opens the gas control valves. The next step is introducing a combustible mixture into the combustion chamber, then removing the control signal. The control signal closes gas control valves and fires the spark system. The next step is igniting the combustible mixture causing the combustible mixture to produces an explosion that ignites the test article, then testing the fire suppression capability of the test article.

The Weapons Survivability Laboratory (WSL) at China Lake, Calif., routinely participates in the testing and evaluation of onboard aircraft firefighting systems. Obviously, in order to test fire suppression abilities, a fire must be created. As a result, an ignition system is required. However, given the unique needs and short program life of the typical project at WSL, the ignition system would ideally possess various attributes.

It is an object of the invention to deliver high energy levels, greater than 20 joules, to ensure reliable ignition of high flashpoint materials.

It is another object of the invention to allow the ignition to be precisely timed to permit the construction of an accurate test timeline.

It is a further object of the invention to prevent interference with any instrumentation that might also be involved with the test to ensure that the confidence level of all data is acceptable.

It is a further object of the invention to create a test environment free from outside factors that may affect the results.

It is a further object of the invention to be reusable as tests may require a point of ignition deep within an aircraft that makes igniter replacement a very labor intensive process.

It is a further object of the invention to be reasonably inexpensive as there is a finite chance that the igniter will be destroyed on any given test.

It is a further object of the invention to be readily adaptable to almost any test article or situation.

It is a further object of the invention to present acceptable safety risks.

It is a further object of the invention to facilitate a reaction between gases that produces an explosion which ignites the test article.

The present invention provides a device that satisfies all the desired objectives.

DETAILED DESCRIPTION OF THE INVENTION

Referring more specifically to the drawings, for illustrative purposes the present invention is embodied in the apparatus as shown in FIG. 1 through FIG. 4. It will be appreciated that the apparatus may vary as to configuration and as to details of the parts without departing from the basic concepts as disclosed herein. The invention is disclosed generally in terms of the testing of fire suppression systems in aircraft. The gas igniter system of the invention, however, may be used for testing in other areas, including but not limited to, automobiles, houses, ships, commercial buildings and anywhere a fire suppression system may be tested or utilized.

Figure 1:
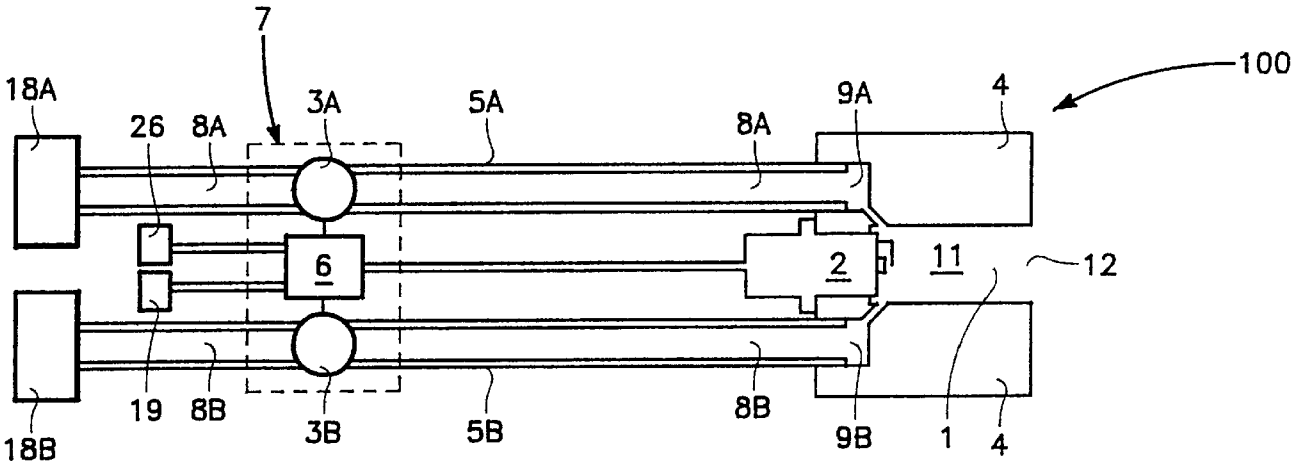
FIG. 1 is a cross sectional illustration of the igniter head which details the gas lines, spark generating means and igniter head outlet port.
Figure 2:
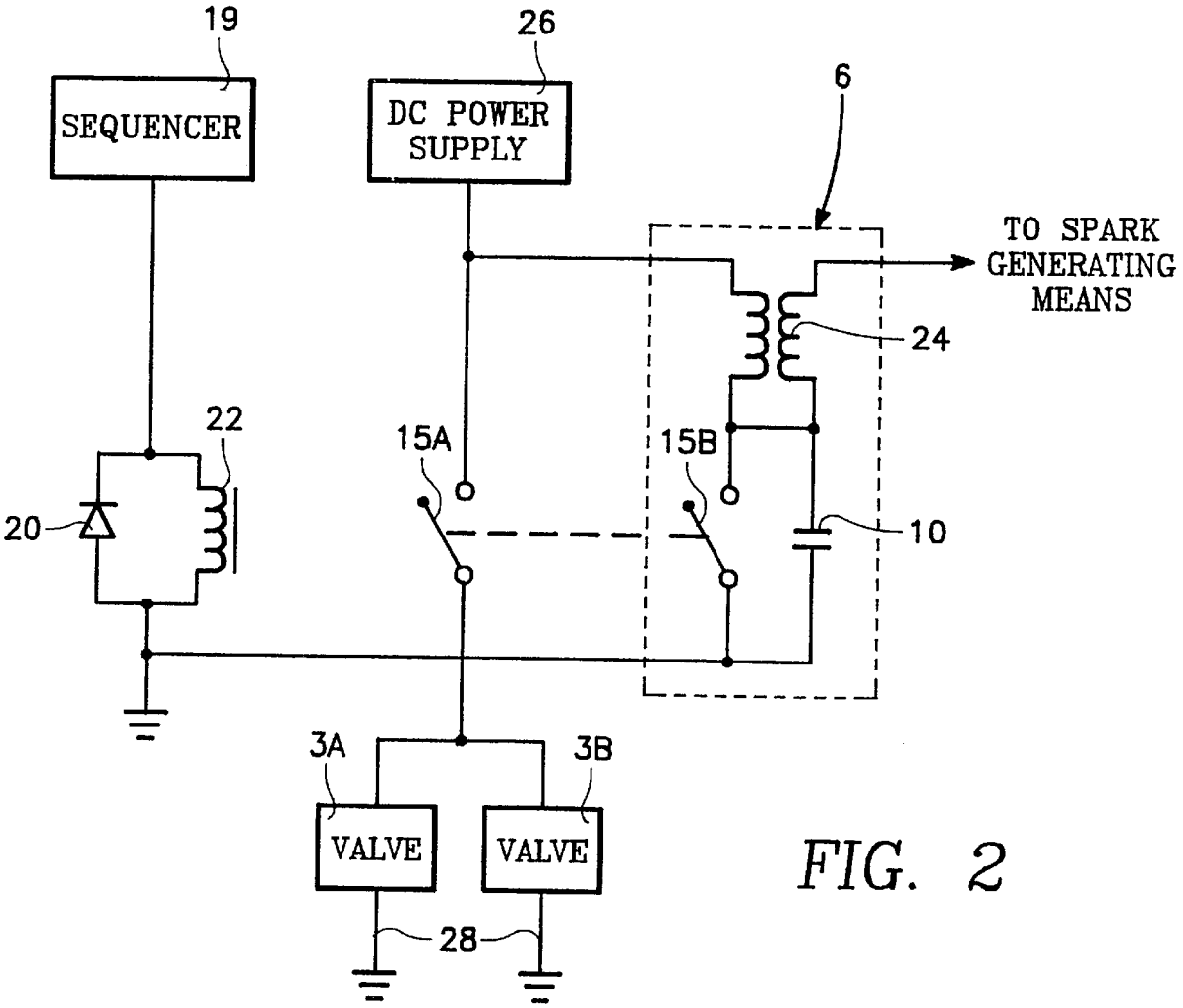
FIG. 2 is an illustration of the control box wiring system which details the spark system, DPDT relay with switches and their relationship with the gas control valves.

Referring to FIGS. 1 and 2, the apparatus 100 generally includes an igniter head 4, which houses a combustion chamber 1 and a spark generating means 2 contained within the combustion chamber 1. The igniter head 4 also contains inlet ports 9A and 9B for gas lines 5A and 5B, which terminate in thee combustion chamber 1 where a combustible gaseous mixture 11 is produced. The spark generating means 2 is part of a spark system 6, which also includes a capacitor 10, a transformer 24 operably coupled to said spark generating means 2 and a means for charging the capacitor 10. A DC power supply 26 provides a means for charging the capacitor 10.

When the control signal is initiated, the control box 7, via double pole double throw (DPDT) relay switches 15A and 15B, simultaneously opens the gas control valves 3A and 3B and energizes the spark system 6. Combustible gas 8A and oxygen gas 8B are forced into the combustion chamber 1 through the gas lines 5A and 5B by the use of pressurized tanks of gas 18A, and 18B. A combustible gaseous mixture 11 accumulates in the combustion chamber 1 of the igniter head 4. After about 1 to 2 seconds, a sufficient amount of the combustible gaseous mixture 11 will enter the combustion chamber 1. At the same time, the capacitor 10 in the spark system 6 accumulates a charge sufficient to ignite the combustible gaseous mixture 11. As illustrated in FIG. 2, in a preferred embodiment, a DC power supply 26 provides a means for charging the capacitor 10. Referring to FIG. 2, a preferred embodiment incorporates a diode 20 and an inductor 22. A transformer 24 increases the voltage and the transformer 24 is operably coupled to the spark generating means 2. The transformer 24 provides a voltage to the spark generating means 2.

Figure 4:
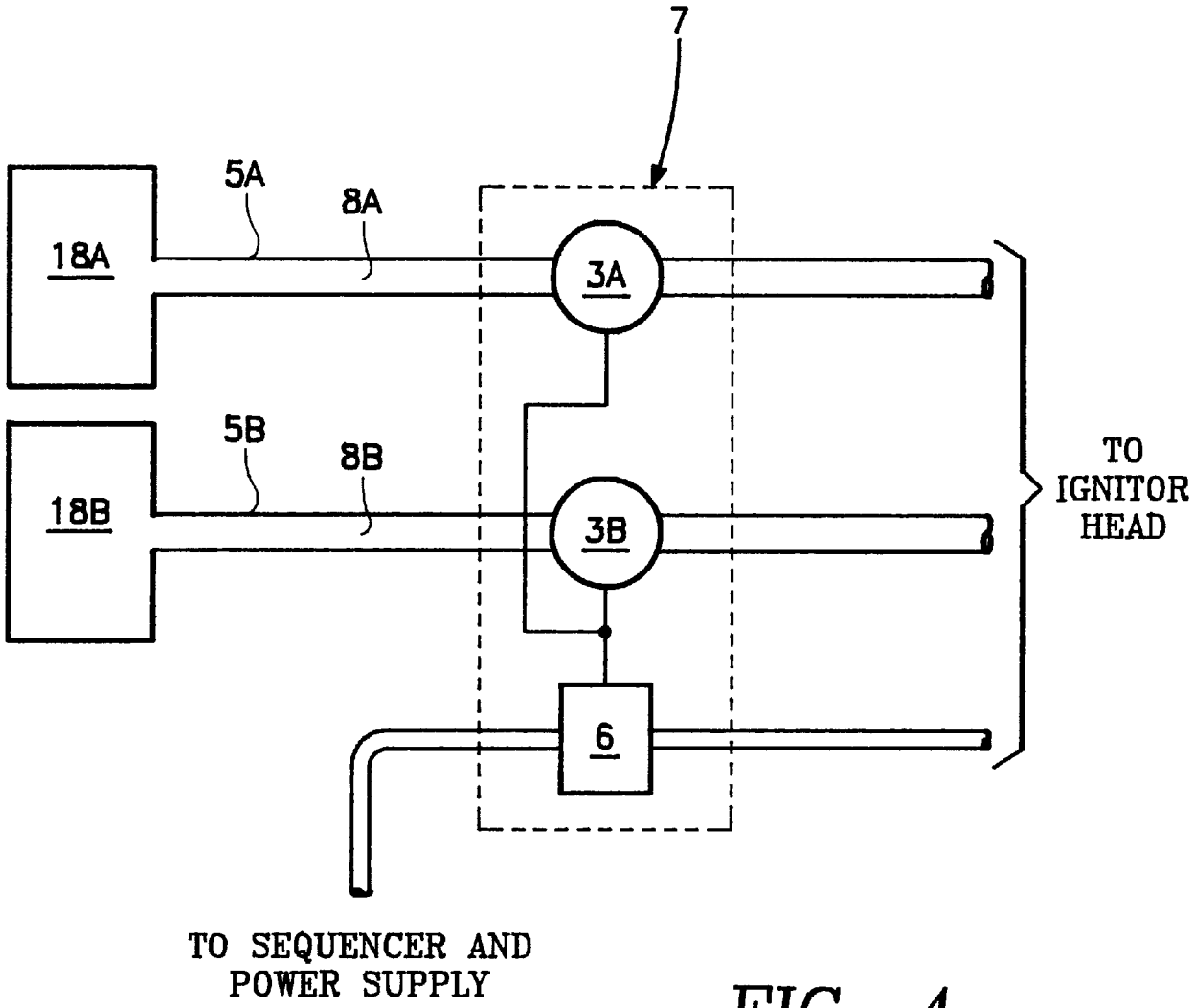
FIG. 4 is a conceptual illustration of the control box which details the relationship of the gas lines and gas control valves inside the control box.

The control signal is removed at the desired moment of ignition, which may be performed by use of an electronic sequencer. A mechanical sequencer may also be used. At this moment, the control box 7, via DPDT relay switches 15A and 15B, simultaneously severs all gas flow by closing the gas control valves 3A and 3A and fires the spark system 6. A ground wire 28 is operably coupled to each gas control valve 3A and 3B. A switch 15B is connected in parallel with the capacitor 10, as illustrated in FIG. 2. The switch 15B fires the spark system 6, at the moment another switch 15A closes the gas control valves 3A and 3B of the gas lines 5A and 5B simultaneously. At the igniter head 4, the spark generating means 2 ignites the combustible gaseous mixture 11. An explosion is produced and a flame or spark is propelled through the combustion chamber outlet port 12, which is intended to ignite the test article and test the fire suppression capability of the test article. FIG. 4 is a conceptual illustration of the gas control valves 3A and 3B and spark system 6 inside the control box 7. In addition, FIG. 4 illustrates an embodiment in which the gas control valves 3A and 3B are situated next to one another with the spark system 6 in end of the control box 7.

Figure 3:
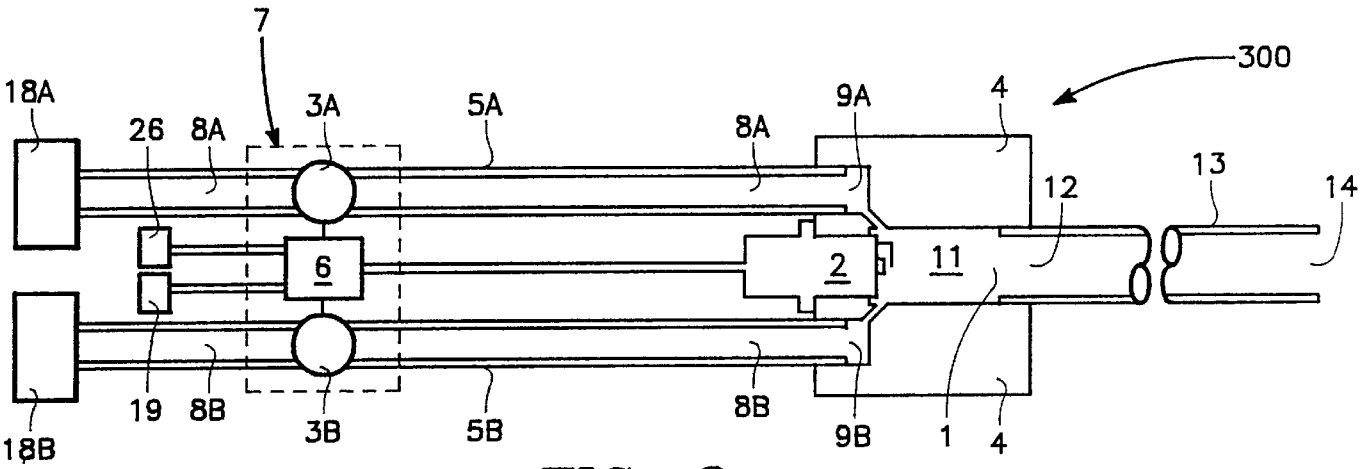
FIG. 3 is a cross sectional illustration of another preferred embodiments of the invention, including tubing attached to the outlet port of the igniter head, in which the tubing is used to create a spark or flame in a remote area.

In another embodiment of the invention, the explosion may be directed to a specific location where the combustion chamber 1 and igniter head 4 cannot reach. Referring to FIG. 3, tubing 13 is attached to the combustion chamber outlet port 12 of the apparatus 300, which enables the flame or spark to be propelled through the tubing outlet port 14. This enables the invention to be used in remote areas of a test article where the larger parts of the invention, such as the combustion chamber 1 and igniter head 4, cannot be placed. Due to the temperature of the flame or spark, about 4080° F., the tubing should be heat resistant to avoid damage to the test article and the tubing itself. The tubing should also be able to withstand the sustained heat produced by the ignited test article, up to 2000° F., depending on thermodynamic factors, such as pressure and amount of oxygen. In the preferred embodiment, stainless steel tubing is used.

In the preferred embodiment, the combustible gas 8A possesses a low molecular weight. This allows the invention to produce a flame or spark with sufficient energy. Ideal low molecular weight combustible gases include methane, acetylene, and hydrogen.

Due to the fact that the invention does not fire until the control signal has been removed, the precision of the timing is limited solely by the response time of the relay.

Although the invention uses an electrical circuit similar in function to a traditional electric arc igniter, the currents involved are negligible in comparison. As a result, interference with instrumentation is not a concern.

The invention may be used repeatedly within a test article thus, avoiding the time consuming task of removing various parts of the test article to retrieve or reset the invention.

It will be that, according to the present invention, an apparatus has been provided facilitating the ignition of test articles from a remote location. The invention has been herein shown and described in what is presently conceived to be the most practical and preferred embodiment thereof. It will be apparent to those of ordinary skill in the art that many modifications may be made within the scope of the invention. The scope of the present invention is to be accorded the broadest interpretation of the appended claims so as to encompass all equivalent structures.

What is claimed is:

1. A gas igniter, comprising:

a combustion chamber having an outlet port;

a first gas line having a control valve, said first gas line having a first end for receiving combustible gas and a second end terminating in said combustion chamber;

a second gas line having a control valve, said second gas line having a first end for receiving oxygen gas and a second end terminating in said combustion chamber, wherein said combustible gas and said oxygen gas mix together to form a combustible mixture in said combustion chamber;

a spark generating means within sa:id combustion chamber, wherein said spark generating means ignites said combustible mixture in said combustion chamber and wherein the igniting of said combustible mixture propels a flame through said outlet port; and a control box having a spark system, a first switch and a second switch, wherein said first switch controls the control valve of said first gas line and the control valve of said second gas line and wherein said second switch controls said spark system.

2. The igniter of claim 1, wherein said combustible gas possesses a low molecular weight.

3. The igniter of claim 1, wherein said combustible gas is selected from the group consisting of hydrogen and acetylene.

4. The igniter of claim 1, wherein said spark generating means is a spark plug.

5. The igniter of claim 1, wherein said combustion chamber is located within an igniter head.

6. The igniter of claim 1, said gas igniter further comprising heat resistant tubing attached to said outlet port, said heat resistant tubing enabling said flame to be propelled into a remote location, said remote location being inaccessible by said combustion chamber.

7. The igniter of claim 1, said control box further comprising a diode in parallel with an inductor.

8. The igniter of claim 1, wherein said spark system comprises:

a transformer operably coupled to said spark generating means;

a capacitor connected in series to said transformer;

means for charging said capacitor, wherein said means for charging said capacitor is a DC power supply; and said second switch connected in parallel with said capacitor, wherein said second switch fires said spark system and said first switch closes said control valve of said first gas line and said control valve of said second gas line simultaneously.

9. The igniter of claim 1, wherein said first switch opens said control valve of said first gas line and said control valve of said second gas line and said second switch energizes said spark system simultaneously, wherein said open control valves allow said combustible gas and said oxygen gas to flow into said combustion chamber and wherein said first switch closes said control valves and said second switch fires said spark system simultaneously.

10. A method of testing fire suppression capability, comprising the steps of:

placing a gas igniter having a combustion chamber in a desired position within a test article;

initiating a control signal, said control signal simultaneously energizing a spark system and opening gas control valves;

introducing a combustible mixture of gases into said combustion chamber;

removing said control signal, said control signal simultaneously closing said gas control valves and firing said spark system;

igniting said combustible mixture of gases, said combustible mixture of gases producing an explosion, said explosion igniting said test article; and testing said fire suppression capability of said test article.

11. The method of claim 10, wherein said gas igniter comprises:

a combustion chamber having an outlet port;

a first gas line having a control valve, said first gas line having a first end originating in a container of combustible gas and a second end terminating in said combustion chamber;

a second gas line having a control valve, said second gas line having a first end originating in a container of oxygen gas and a second end terminating in said combustion chamber, wherein said combustible gas and said oxygen gas mix together to form a combustible mixture in said combustion chamber;

a spark generating means within said combustion chamber, wherein said spark generating means ignites said combustible mixture in said combustion chamber and wherein the igniting of said combustible mixture propels a flame through said outlet port; and a control box having a spark system, a first switch and a second switch, wherein said first switch controls the control valve of said first gas line and the control valve of said second gas line and wherein said second switch controls said spark system.

12. The method of claim 11, wherein said spark generating means is a spark plug.

13. The method of claim 11, wherein said combustion chamber is located within an igniter head.

14. The method of claim 11, wherein said gas igniter further comprises heat resistant tubing attached to said outlet port, said heat resistant tubing enabling said flame to be propelled into a remote location, said remote location being inaccessible by said gas igniter.

15. The igniter of claim 11, wherein said first switch opens said control valve of said first gas line and said control valve of said second gas line and said second switch energizes said spark system simultaneously, wherein said open control valves allow said combustible gas and said oxygen to flow into said combustion chamber and wherein said first switch closes said control valves and said second switch fires said spark system simultaneously.

16. The method of claim 10, wherein said spark system comprises:

a transformer operably coupled to said spark generating means;

a capacitor in series with said transformer;

means for charging said capacitor, wherein said means for charging is a DC power supply; and said second switch connected in parallel with said capacitor, wherein said second switch fires said spark system and said first switch closes said control valve of said first gas line and said control valve of said second gas line simultaneously.

17. The igniter of claim 10, wherein said combustible gas is selected from the group consisting of hydrogen and acetylene.

* * * * *